US005549964A

United States Patent [19]

Shohji et al.

[11] Patent Number: 5,549,964

[45] Date of Patent: Aug. 27, 1996

[54] STRETCHABLE NONWOVEN FABRIC AND METHOD OF MANUFACTURING THE SAME

[75] Inventors: Kohichi Shohji; Masataka Ikeda, both of Nobeoka; Yasushi Kishimoto, Kawasaki, all of Japan

[73] Assignee: Asahi Kasei Kogyo Kabushiki Kaisha, Osaka, Japan

[21] Appl. No.: 371,490

[22] Filed: Jan. 11, 1995

Related U.S. Application Data

[63] Continuation of Ser. No. 27,606, Mar. 5, 1993, abandoned, which is a continuation of Ser. No. 691,056, Jun. 27, 1991, abandoned.

[30] Foreign Application Priority Data

Dec. 27, 1988 [JP] Japan ..... 63-327935

[51] Int. Cl.[6] ..... D02G 3/00; D04N 1/04; C08K 3/00

[52] U.S. Cl. ..... 428/224; 428/288; 428/296; 428/375; 428/401; 523/522

[58] Field of Search ..... 428/221, 224, 428/373, 288, 296, 375, 401; 520/407; 523/522

[56] References Cited

U.S. PATENT DOCUMENTS

| | | | |
|---|---|---|---|
| 3,755,527 | 8/1973 | Keller et al. | 264/210 |
| 3,849,241 | 11/1974 | Butin et al. | 264/210 |
| 3,978,185 | 8/1976 | Butin et al. | 264/93 |
| 4,168,286 | 9/1979 | Moczygemba . | |
| 4,215,682 | 8/1980 | Kubik et al. . | |
| 4,501,857 | 2/1985 | Kishimoto et al. | 525/388 |
| 4,612,228 | 9/1986 | Kato et al. . | |
| 4,628,072 | 12/1986 | Shiraki et al. . | |
| 4,657,802 | 4/1987 | Morman . | |
| 4,663,220 | 5/1987 | Wisneski et al. . | |
| 4,673,714 | 6/1987 | Kishimoto et al. | 525/314 |
| 4,692,371 | 9/1987 | Morman et al. . | |
| 4,707,398 | 11/1987 | Boggs | 428/373 |
| 4,720,415 | 1/1988 | Vander Wielen et al. | 428/152 |
| 4,741,949 | 5/1988 | Morman et al. | 428/373 |
| 4,762,878 | 8/1988 | Takeda et al. | 524/490 |
| 4,772,657 | 9/1988 | Akiyama et al. | 524/474 |
| 4,789,699 | 12/1988 | Kieffer et al. | 428/221 |
| 4,892,903 | 1/1990 | Himes | 524/488 |
| 4,950,529 | 8/1990 | Ikeda et al. | 428/224 |
| 5,024,667 | 6/1991 | Malcolm et al. | 428/284 |
| 5,057,571 | 10/1991 | Malcolm et al. | 524/505 |

FOREIGN PATENT DOCUMENTS 0254346 1/1988 European Pat. Off. .

OTHER PUBLICATIONS

May 15, 1992 Communication EPA 90 90 0366, European Search Report, and Annex to European Search Report.

*Primary Examiner*—Terrel Morris

*Attorney, Agent, or Firm*—Finnegan, Henderson, Farabow, Garrett and Dunner

[57] ABSTRACT

A stretchable nonwoven fabric manufactured by using a hydrogenated block copolymer obtained by hydrogenating a block copolymer including polymer blocks A constituted mainly by a vinyl aromatic compound and a polymer block B constituted mainly by a conjugated diene compound, at least one polymer block B being arranged on an end of a polymer chain of the block copolymer, as a raw material. The spinning property and characteristics of the nonwoven fabric can be further improved by adding a polyolefin to the above raw material.

The obtained stretchable nonwoven fabric has a superior strength, extension characteristics, i.e., elongation and extension recovery, and weathering resistance, and can be broadly used for many applications due to those characteristics.

6 Claims, 3 Drawing Sheets

STRETCHABLE NONWOVEN FABRIC AND METHOD OF MANUFACTURING THE SAME

RELATED APPLICATIONS

This application is a continuation of application Ser. No. 08/027,606, filed Mar. 5, 1993, now abandoned, which is in turn a continuation of Ser. No. 07/691,056, filed as PCT/JP89/01294, Dec. 25, 1989 published as WO90/07602, Jul. 12, 1990, also abandoned.

TECHNICAL FIELD

This invention relates to a stretchable nonwoven fabric and a method of manufacturing the same. More particularly, this invention relates to a stretchable nonwoven fabric manufactured by using a hydrogenated block copolymer as a main material and having a superior strength, extension characteristics, i.e., elongation and extension recovery properties, weathering resistance, light resistance, heat resistance, chemical resistance and electrical resistance, and a soft handling, and a method of manufacturing the same.

PRIOR ART

Nonwoven fabrics of various synthetic fibers including a nonwoven fabric obtained by spinning a thermoplastic resin by using a melt blown method are known.

An essential technique for the melt blown spinning method and an apparatus therefor is disclosed in "Industrial and Engineering Chemistry", volume 48, No. 8, 1956, from pages 1342 to 1346. Further, stretchable nonwoven fabrics manufactured by the melt blown method are known, as described hereafter.

Japanese Unexamined Patent Publication (Kokai) No. 59-223447 discloses a melt blown nonwoven fabric composed of a polyurethane elastic filament; Japanese Unexamined Patent Publication (Kokai) No. 1-132858 discloses a melt blown nonwoven fabric composed of a polyurethane using a polyester diol; U.S. Pat. No. 4,692,371 discloses a melt blown nonwoven fabric composed of an A-B-A' block polymer; and Japanese Unexamined Patent Publication (Kokai) No. 62-84143 discloses a melt blown nonwoven fabric composed of an A-B-A' block polymer and a polyolefin.

Also, a thermoplastic material Kraton® known as a typical material having a block copolymer composition and a hydrogenate thereof, and the block copolymer composition and the hydrogenate thereof are disclosed in Japanese Unexamined Patent Publications (Kokai) No. 61-42554 and No. 61-155446.

The thermoplastic material Kraton® is described in detail in the reference "KRATON® THERMOPLASTIC RUBBER Typical Properties 1986" issued by the Shell Chemical Company, the most general structure being a linear A-B-A block type, and Kraton D series such as a styrene-butadiene-styrene (S-B-S) and a styrene-isoprene-styrene (S-I-S), and Kraton G series such as a styrene-ethylene/butylene-styrene (S-EB-S) are included in this type.

Japanese Unexamined Patent Publication (Kokai) No. 61-42554 discloses a composition composed of a hydrogenated block copolymer of 100 parts by weight including at least one polymer block A constituted mainly by a vinyl aromatic compound and at least one polymer block B constituted mainly by a conjugated diene compound, and a hindered amine group compound of 0.01 part by weight to 3 parts by weight.

Japanese Unexamined Patent Publication (Kokai) No. 61-155446 discloses a composition composed of a hydrogenated block copolymer of 100 weight portion having a block copolymer which includes at least two polymer blocks A constituted mainly by a vinyl aromatic compound and at least two polymer blocks B constituted mainly by a conjugated diene compound, and having a number-average molecular weight of between 20,000 and 100,000 and a polyolefin of 5 parts by weight to 400 parts by weight.

The above known melt blown nonwoven fabric has the following problems.

Namely, the melt blown nonwoven fabrics disclosed in Japanese Unexamined Patent Publications (Kokai) No. 59-223347 and No. 1-132858 are nonwoven fabrics manufactured of polyurethane, and accordingly, those nonwoven fabric have problems of a poor weathering resistance and light resistance. Further, the polyurethane itself is very expensive, and accordingly, these nonwoven fabrics have a problem in that the price of the nonwoven fabric becomes expensive.

In the melt blown nonwoven fabric disclosed in U.S. Pat. No. 4,692,371, KRATON GX 1657 is used as the A-B-A' hydrogenated block copolymer and the hydrogenated block copolymer is individually extruded to form a web. This nonwoven fabric has problems in that a strength of the nonwoven fabric is weak, as shown in the Table II of the above U.S. Patent, and it is impossible to make a mean diameter of fibers in the nonwoven fabric thinner, due to a high melting viscosity thereof.

A nonwoven fabric disclosed in Japanese Unexamined Patent Publication No. 62-84143 and composed of the A-B-A' hydrogenated block copolymer and the polyethylene has a problem in that a strength of the nonwoven fabric is weak (see Table 7 in a description of examples described hereafter).

DISCLOSURE OF THE INVENTION

A first object of the present invention is to solve the problems of the prior art and to provide a stretchable nonwoven fabric having a superior strength, extendable characteristics, i.e., elongation and elastic recovery of elongation, weathering resistance, light resistance, heat resistance, chemical resistance and electrical resistance, and a soft handling.

A second object of the present invention is to provide a method of manufacturing a superior stretchable nonwoven fabric composed of a hydrogenated block copolymer.

A third object of the present invention is to provide a stretchable nonwoven fabric having a soft and non-sticky handling and a superior strength, extendable characteristics, weathering, light resistance, and heat resistance.

The nonwoven fabric including a hydrogenated block copolymer of A-B-A' type and manufactured by the melt blown method is known as described before, but in the above known technique, a constitution of the hydrogenated block copolymer, i.e., a block structure, a number-average molecular weight, a content of a vinyl aromatic compound, a 1,2-vinyl content of a conjugated diene compound or the like, a spinning ability in the melt blown method, and characteristics of the stretchable nonwoven fabric obtained are synthetically studied, has not been found before.

The inventors in the present application synthetically studied the constitution of the hydrogenated block copolymer, the spinning ability in the melt blown method, and the characteristics of the stretchable nonwoven fabric, and thus accomplished the present invention.

The first object of the present invention can be attained by a stretchable nonwoven fabric composed of a thermoplastic fiber manufactured from a hydrogenated block copolymer obtained by hydrogenating a block copolymer including at least two polymer blocks A constituted mainly by a vinyl aromatic compound and at least two polymer blocks B constituted mainly by a conjugated diene compound, at least one polymer block B being arranged on an end of a polymer chain thereof, a number-average molecular weight of the block copolymer being between 30,000 and 65,000 and a content of the vinyl aromatic compound in the block copolymer being between 15 wt % and 40 wt %.

The second object of the present invention can be attained by a method of manufacturing a stretchable nonwoven fabric, wherein a block copolymer including at least two polymer blocks A of a vinyl aromatic compound and at least two polymer blocks B of a conjugated diene compound, and in which a content of the vinyl aromatic compound is between 15 wt % and 40 wt % and at least one polymer block B is arranged on an end of a polymer chain, a number average molecular weight of which is between 30,000 and 65,000, is manufactured by a sequential block copolymerization, said block copolymer is hydrogenated, the obtained hydrogenated block copolymer is spun; and a spun polymer obtained by a spinning process is accumulated on a collecting face to form a fiber web.

The third object of the present invention can be attained by a stretchable nonwoven fabric composed of a fiber comprising a hydrogenated block copolymer C obtained by hydrogenating a block copolymer including at least two polymer blocks A constituted mainly by a vinyl aromatic compound and at least two polymer blocks B constituted mainly by a conjugated diene compound and on an end of a polymer chain of which at least one polymer block B is arranged, and a polyolefin D, wherein a blending ratio (C/D) of the hydrogenated block copolymer and the polyolefin D is between 40/60 and 99/1.

BEST MODE OF CARRYING OUT THE INVENTION

Figure 1:
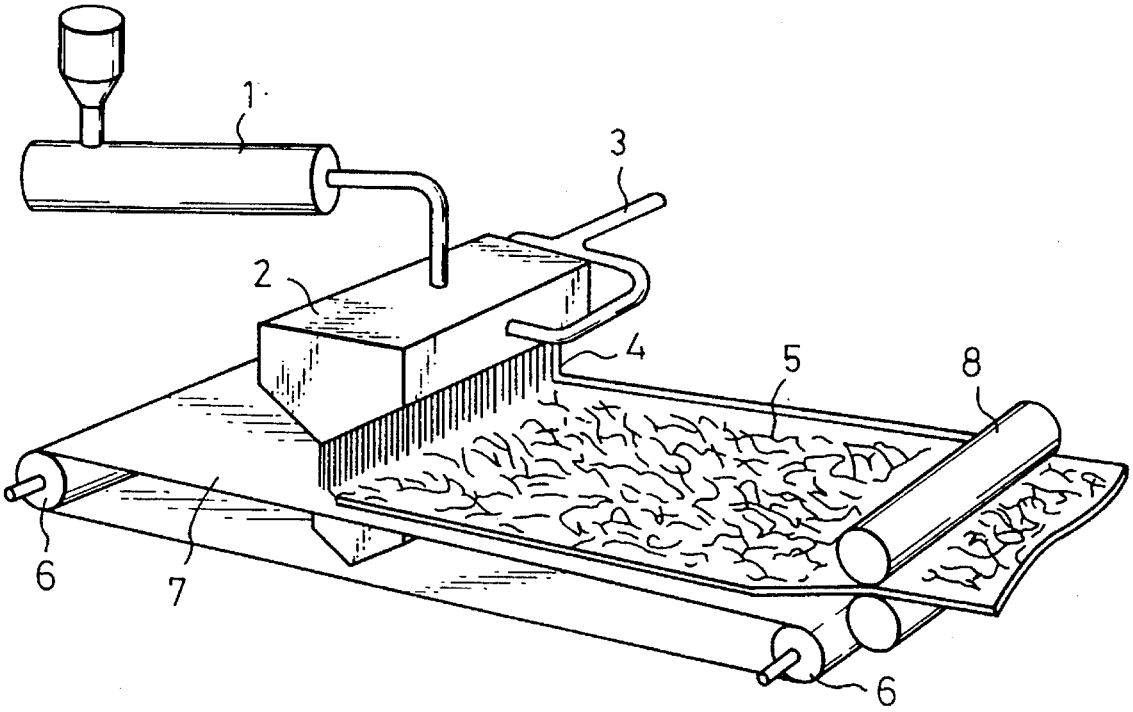
FIG. 1 is a perspective view illustrating an example of an apparatus for manufacturing a nonwoven fabric by a melt blown method.

As the vinyl aromatic compound constituting the block copolymer before the hydrogenation (hereinafter referred to as a pre-polymer), for example, styrene, a-methylstyrene, vinyltoluene, p-tert-butylstyrene and the like can be used, but styrene is most preferred. These compounds can be used alone or as a combination of two or more thereof. Conversely, as the conjugated diene compound constituting the pre-polymer, for example, 1,3-butadiene, isoprene, 1,3-pentadiene, 2,3-dimethyl-1,3-butadiene, or the like can be used, but butadiene and isoprene are most preferred. These compounds can be used alone or as a combination of two or more thereof.

These pre-polymers can be manufactured by a successive block copolymerization, with the aid of a lithium alkyl catalyst, or by a coupling reaction after the successive block copolymerization, and subsequently, the thus obtained pre-polymer is selectively hydrogenated. Namely, the hydrogenating reaction can be conducted by the use of known hydrogenating catalysts, for example, precious metallic support catalysts such as platinum and palladium, catalysts such as Raney nickel, organo-nickel compounds, and organo-cobalt compounds, or a complex catalyst of these compounds and other organometallic compounds. In particular, a titanocene compound is preferable because it has an extremely high activity as a hydrogenating catalyst for the block copolymer, a small amount of the catalyst is needed for the hydrogenating reaction, and the catalyst residue does not adversely affect a heat-resistance stability of the hydrogenated block copolymer, and thus there is no need for the removal of the catalyst residue, as disclosed in Japanese Unexamined Patent Publication (Kokai) No. 61-155446.

Preferably, the hydrogenation is selectively conducted for a double bond of the conjugated diene compound. Namely, the hydrogenation should be selectively conducted because a double bonding of the conjugated diene compound leads to a deterioration in the weathering resistance, light exposure resistance, and heat resistance, which is undesirable. Conversely, in the case of a vinyl aromatic compound, the hydrogenation causes a poor fluidity, which is undesirable from the viewpoint of the spinning properties.

Namely, a partial hydrogenation where at least 80%, preferably 90% of the conjugated diene compound is hydrogenated, and at most 20%, preferably 5%, of the vinyl aromatic compound is hydrogenated, is preferable with respect to the resistances to weather light and heat, and the spinning properties of the nonwoven fabric.

The number-average molecular weight of a pre-polymer in total (hereinafter abbreviated as $M_n$) is within the range of 30,000 to 65,000, preferably 35,000 to 60,000, more preferably 40,000 to 55,000. When the $M_n$ is lowered, the strength of the single fiber, and accordingly, the strength of the nonwoven fabric, is lowered. In particular, with an $M_n$ under 30,000, a chip cannot be obtained due to a lowering of a viscosity of the polymer. Also, when the $M_n$ is raised, the spinning properties become unsatisfactory due to a rise in the pressure in the die part, as well as a rise in the melt viscosity of the conjugated diene compound. Further, when the $M_n$ is over 65,000, it is impossible to obtain the fiber.

Furthermore, the content of the vinyl aromatic compound in the pre-polymer should be within 15 to 40 percent by weight (hereinafter abbreviated as wt %), preferably 20 to 35 wt %. In the hydrogenated block copolymer, the vinyl aromatic compound serves as a hard segment which contributes to the strength of the material, and the conjugated diene compound serves as a soft segment which contributes to the stretchability. A strength of the polymer increases in accordance with a content of the vinyl aromatic compound, but a strength of the nonwoven fabric has a maximum value with regard to a content of the vinyl aromatic compound. Namely, when the content of the vinyl aromatic compound is under 15 wt %, the strength of the nonwoven fabric becomes too low, and thus a nonwoven fabric having broad application cannot be obtained. In contrast, when the content of the vinyl aromatic compound is over 40 wt %, the strength and the elongation of the nonwoven fabric are lowered, and the nonwoven fabric becomes hard. Also the melt viscosity, and accordingly the pressure in the die part, are raised, which results in inferior spinning properties. The thus-produced nonwoven fabric includes polymer balls, and has a larger average fiber diameter, poor dispersion properties of the single fiber, and an inferior feeling and appearance, and thus cannot be used as a product. Therefore, within the range of 15 to 40 wt %, the spinning properties are satisfactory, and a soft and high quality nonwoven fabric having a superior strength and elongation can be obtained.

A 1,2-vinyl content of the conjugated diene structure of the conjugated diene compound of the pre-polymer is preferably within the range of 20 to 50 wt %, more preferably 25 to 45 wt %. When the bonding amount is less than 20 wt %, a recovery of the elongation of the obtained nonwoven fabric is poor, and the thus obtained nonwoven fabric is poor, and the thus obtained nonwoven fabric cannot be used as a product. In contrast, when the bonding amount is more than 50%, the spinning properties are poor, and a superior web cannot be obtained.

At least one polymer block B must be arranged on an end of a polymer chain of the pre-polymer, because the spinning property and characteristics of the nonwoven fabric depend on a ratio of the polymer block for all ends of the polymer chain.

The ratio of the polymer block B for all ends of the polymer chain in the pre-polymer is preferably within 3 to 25 wt %, more preferably 5 to 20 wt %. When the ratio is less than 3%, a superior web cannot be obtained due to a high melt viscosity and an inferior spinning property. In contrast, when the ratio is more than 25 wt %, the strength of the nonwoven fabric is lowered.

As described in detail in the examples given hereafter with reference to Table 2, a comparative experiment is conducted, under the same spinning conditions, using KRATON® G-1652 and KRATON® G 1657X.

The spinning property of G-1652 is poor due to a lower flowability, the fibers cannot be continued and many polymer balls are generated, and thus a sample of the nonwoven fabric cannot be obtained. Although a sample of a nonwoven fabric can be obtained from G-1657X, the strength of the nonwoven fabric is extremely low despite a high value of a strength of the polymer.

As described above, a nonwoven fabric product having a superior appearance and handling, a very high strength, and superior extendable characteristics and softness can be obtained by using the block copolymer including at least two polymer blocks A constituted mainly by the vinyl aromatic compound and at least two polymer blocks B constituted mainly by a conjugated diene compound, at least one polymer block B being arranged on an end of a polymer as the pre-polymer of the hydrogenated block copolymer in the present invention. Further in the manufacture of the nonwoven fabric in the present invention, the spinning property is improved due to the lower melt viscosity and the superior flowability thereof.

The pre-polymer may have a linear, divergent, or radial constitution, examples of which are expressed by the following general formulae.

| | |
|---|---|
| $(B-A)n$ | $n \geqq 2$ |
| $(B-A)n-B$ | $n \geqq 2$ |
| $(B-A)m-X(B-A)n$ | $m,n \geqq 1,\ m+n=2 \cong 4$ |

As a stabilizer for the hydrogenated block copolymer used in the present invention, a hindered amine compound, hindered phenol compound, phosphorus compound, benzophenone compound, benzotriazole compound, and a mixture thereof can be used. An improvement of the heat resistance and weathering resistance of the hindered amine is remarkable, and accordingly, more preferably the hindered amine is used as the stabilizer. If the content of the stabilizer is more than 5 parts by weight per 100 parts by weight of the hydrogenated block copolymer, coloring and other drawbacks can arise without a corresponding further improvement in the effects of the stabilizer.

A value of adhesion of the stretchable nonwoven fabric can be widely changed according to the type of pre-polymer used. The peel strength of the nonwoven fabric can be used to measure the adhesion, when the peel strength is high, the adhesion of the nonwoven fabric is also high.

Although a constitution depending on the peel strength of the pre-polymer has been investigated, this cannot be generally determined only by a specific element in the constitution. Accordingly, the inventors of the present invention introduced an adhesion parameter T defined from the following equation, and found that the value of T has a clear relationship to the peel strength, i.e., the adhesion of the nonwoven fabric.

$$T=V/S$$

wherein V denotes a 1,2-vinyl content of a conjugated diene structure in a conjugated diene compound and expressed by wt %, and S denotes a content of a vinyl aromatic compound in a pre-polymer and expressed by wt %.

Figure 3:
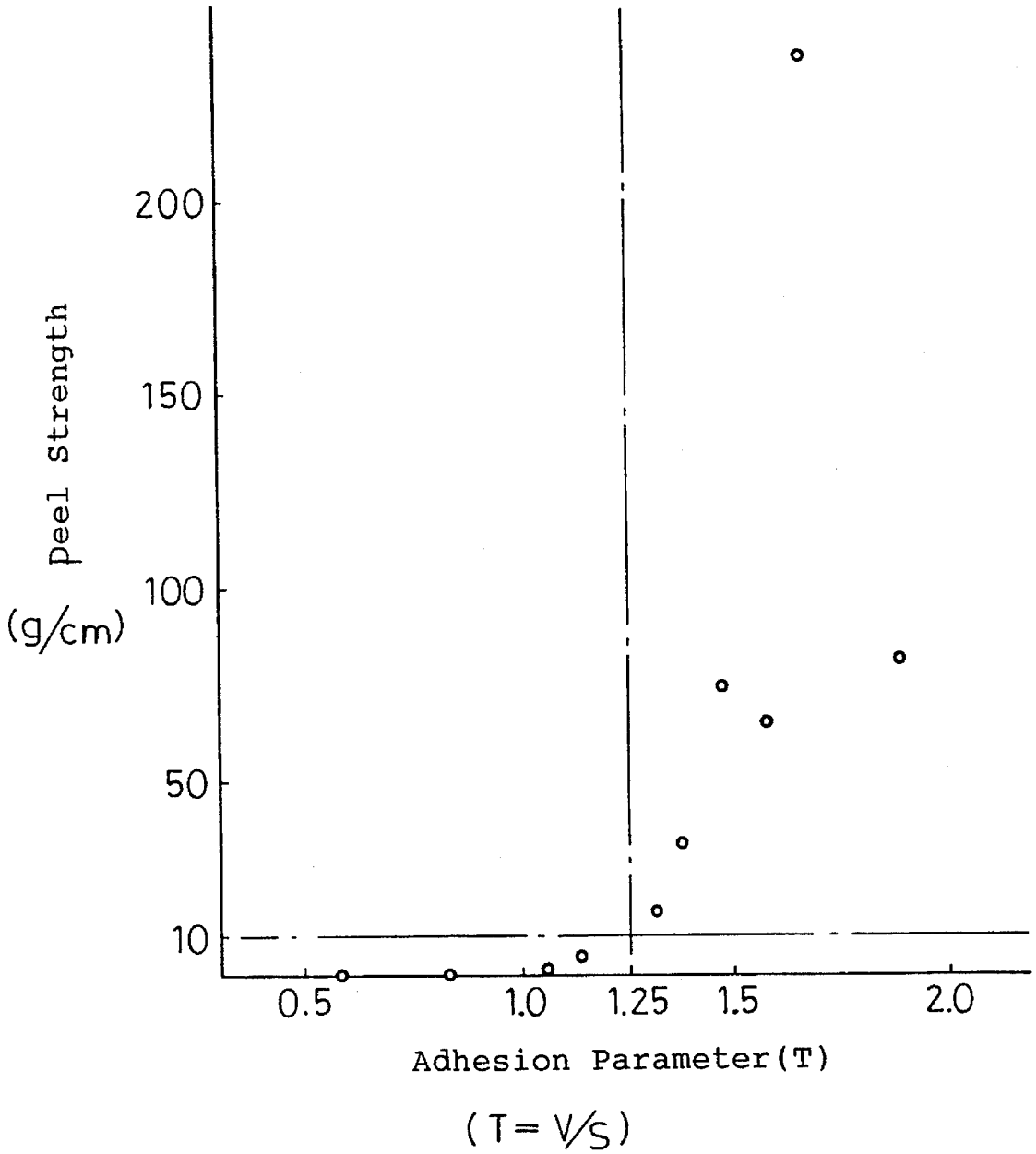
FIG. 3 is a graph illustrating a relationship between a tackiness parameter (T=V/S) of a polymer and a peeling strength of a nonwoven fabric.

Namely, as shown in FIG. 3, the adhesion can be divided into two portions, from a boundary having a T value of 1.25; i.e., when T is greater than 1.25, the adhesion becomes larger, and when T is lower than 1.25, the peel strength is lower than 10 g/cm and thus there is substantially no adhesion in practical use.

The applications of the nonwoven fabrics can be determined according to the value of the nonwoven fabric, and the nonwoven fabric having an adhesion T of more than 1.25 can be suitably used for applications such as diaper, apparel or the like, as a laminated material formed by piling the nonwoven fabric of the present invention on another nonwoven fabric, a knitted fabric, a woven fabric or the like. In contrast, the nonwoven fabric having an adhesion T of less than 1.25, i.e., a nonwoven fabric having no adhesion, can be used for applications wherein the nonwoven fabric is used alone, e.g., for gloves, hats, stretch tapes used for, example, in a waist bund of a diaper, or the like.

It is possible to manufacture a stretchable nonwoven fabric having further improved properties by adding a polyolefin to a hydrogenated block copolymer used to manufacture the stretchable nonwoven fabric of the present invention.

When the polyolefin is blended with the hydrogenated block copolymer, a melt viscosity of the blended polymer becomes lower, and thus the spinning property is improved, and a mean diameter of fibers in the nonwoven fabric becomes smaller and therefore, no adhesion appears. Nevertheless, when the blending ratio of the polyolefin is too high, an elastic recovery from an elongation of the nonwoven fabric is lowered. Accordingly, a blending ratio of the polyolefin to a total weight of the polymer may be determined to be from 1 to 60 wt %, preferably 5 to 50 wt %, more preferably 10 to 40 wt %. When the polyolefin is less than 1%, there is little lowering of the melt viscosity and no improvement of the spinning property. In contrast, when the polyolefin is more than 60 wt %, the elongation and elastic recovery from the elongation become very poor.

When a number-average molecular weight (Mn) of the polyolefin is small, there is a tendency for the elastic recovery from an elongation to become higher at the same blending ratio.

The reason why the above tendency is generated is not apparent, but it is considered that a microdomain structure formed by the polyolefin and the conjugated diene compound of the hydrogenated block copolymer easily occurs when the number-average molecular weight of the polyolefin is small.

Examples of the polyolefin usable in the present invention are a polyethylene, a polypropylene, and a copolymer of propylene with a-olefin such as ethylene or 1-butane. Most preferably, a block copolymer of propylene with ethylene, the polypropylene and the polyethylene are used.

Preferably, a polypropylene having the number-average molecular weight (Mn) of 2,000 to 60,000 and a melting flow rate (MFR) of 50 to 10,000, more preferably 50 to 150, is used and a polyethylene having Mn of 2,000 to 30,000 is used. The use of the polyethylene is preferable, because this reduces the lowering of the elastic recovery from an elongation.

Three blending states of two polymer, exist, i.e., that wherein two polymers are blended in a single fiber, that wherein fibers constituted by a specific polymer, respectively, are mixed in a nonwoven fabric, and that wherein the two above states are present in the nonwoven fabric. Most preferably, the first state wherein the two polymers are blended in the single fiber is used.

A method of blending two polymers when spinning the polymers, and a method of using a chip in which the two polymers are previously blended by melting the two polymers or the like, can be used as the method of blending the hydrogenated block copolymer with the polyolefin. Although the method of blending the two polymers is not especially limited, the latter method is preferred.

A third polymer may be added to a fiber of the stretchable nonwoven fabric within a range which does not adversely affect the object of the present invention. Further, another fiber may be blended with the nonwoven fabric of the present invention, within a range which do not adversely affect the object of the present invention. As described hereafter, the stretchable nonwoven fabric of the present invention can be manufactured by a melt blown method, but when the nonwoven fabric is manufactured only from the hydrogenated block copolymer, i.e., without the polyolefin, the use of a heated gas having a high speed and high pressure, i.e., 1.2 kg/cm$^2$G or more produces a poor blowability, and thus the manufacturing of the fiber becomes difficult. Accordingly, an optimum pressure of the heated and high speed gas must be between 0.1 and 1.2 kg/cm$^2$G, and accordingly, a fiber in the nonwoven fabric obtained must have a relatively thick diameter, e.g., about 10 μM or more.

Nevertheless, where a polypropylene is used as the polyolefin and two polymers are blended in a chip to make a nonwoven fabric, when a blending ratio of the polypropylene is increased, a blowing operation under a high pressure e.g., 3 kg/cm$^2$G, becomes possible due to a lowering of the melt viscosity, and the blowability is abruptly improved from a blending ratio of around 10 wt %. Further, a fiber in the obtained nonwoven fabric becomes an extra fine fiber, and thus a nonwoven fabric having an extremely soft handling is obtained. An elastic recovery from elongation, which is a superior feature of the stretchable nonwoven fabric of the present invention, is maintained up to a blending ratio of 30 wt % of the polypropylene, without any substantial change. The blending ratio of the polypropylene may be increased to 60 wt %, in practical use. As described above, when the polypropylene is blended with the hydrogenated block copolymer, as the polyolefin, a melt viscosity of the blended polymer becomes lower, the spinning property is remarkably improved, and it becomes possible to raise a pressure of the gas, and thus the present invention has a feature that an extra fine fiber having a mean diameter of less than 10 μM can be obtained. Further, an effect that a strength of the nonwoven fabric is further improved by blending the polypropylene, and an adhesion of the nonwoven fabric is lowered, is obtained.

A mean diameter of a fiber constituting the stretchable nonwoven fabric of the present invention is less than 50 μM, preferably 0.5 to 30 μM. When the mean diameter is less than 0.5 μM, the obtained nonwoven fabric is soft but has a lower strength and poor air permeability and moisture permeability. In contrast, when the mean diameter is more than 50 μM, the nonwoven fabric has a rough feel and a hard handling, and a waterproof pressure and bacteria barrier property of the nonwoven fabric become poor. In particular, when the mean diameter is less than 10 μM, and further, is between 1.0 and 6.0 μM, a collective efficiency, air permeability, moisture permeability and handling of the nonwoven fabric are improved, and the nonwoven fabric has a preferable high waterproof resistance and superior bacteria barrier and dust collecting properties.

Preferably, the nonwoven fabric in the present invention has a weight per unit area of 5 to 500 g/m, more preferably 10 to 200 g/m$^2$. When the weight per unit area is lower than 5 g/m, the strength of the stretchable nonwoven fabric is lowered.

A staple fiber and a filament may be used as the fiber constituting the stretchable nonwoven fabric of the present invention, but in view of a strength of the nonwoven fabric, the filament is preferable. The thus-obtained stretchable nonwoven fabric of the present invention has a superior extendability (elongation, and extension recovery), a superior resistance to weather, light, heat, and chemicals, and superior electrical insulating properties, as well as a soft feel. The resistance to weather thereof is superior in particular to the polyurethane stretchable nonwoven fabric now on the market (for example, ESPANSIORE®).

As a method of manufacturing the stretchable nonwoven fabric of the present invention, a melt blown method, a spun bond method, and a method in which a fiber obtained by the melt spinning method is sheeted out by an ordinary dry process or wet process, can be used, but in view of the spinning properties, the melt blown method is most preferable.

Figure 2:
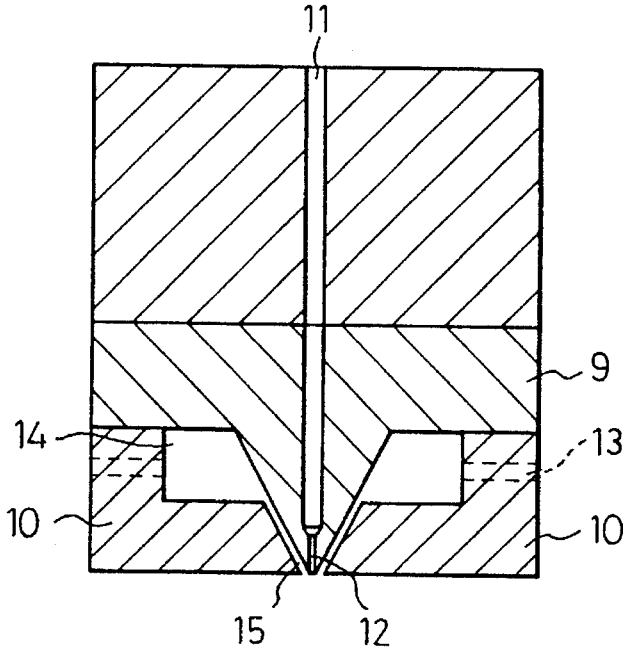
FIG. 2 is a cross sectional view illustrating a die used in the melt blown method.

An example of the melt blown method of the present invention will be described with reference to FIGS. 1 and 2.

A hydrogenated block copolymer is melted by an extruder 1 to be fed into a die 2, and extruded from multiple spinning orifices arranged in a line on a nozzle. The molten polymer is extruded from the orifice 12 through a polymer flow path 11, and at the same time, a heated high-speed gas, supplied through a gas inlet 13, is injected from slits 15 provided on both sides of the orifice 12 through a gas header 14, and blown onto the flow of the extruded molten polymer. The gas header 14 and the injection slit 15 can be provided between the nozzle 9 and a lip 10. The molten polymer extruded with the aid of the high-speed air flow is drawn, thinned, and hardened into extra fine fibers 4, and the thus-produced extra fine fibers are deposited on a screen (a collector) 7 circulating between a pair of revolving rollers 6, 6, to thus form a random web. As the gas steam or air or the like is preferred, and the gas conditions are a temperature of 300° to 450° C., preferably 350° to 420° C., and a pressure of 0.1 kg/cm$^2$G or more, preferably 0.2 to 5.0 kg/cm$^2$G, which differs depending on the discharge rate. The temperature of the extruder is 260° to 330° C., preferably 260° to 330° C., and the temperature of the die is 260° to 330° C., preferably 270° to 320° C.

A strength of a raw web i.e., a web to which an after-treatment is not applied, has a high strength obtained due to an entanglement of fibers, and a self-heat bonding property without the after-treatment. Accordingly, it is important to suitably determine a distance between a distance between a die 2 and a collector 7, for an improvement of the strength of the nonwoven fabric caused by bonding the fibers having the self-heat bonding property, i.e., when the distance is shortened, the strength is increased. Further, it is preferable to shorten the distance to increase the dispersion of the fibers in the nonwoven fabric. Namely, the distance is preferably 70 cm or less, more preferably 50 cm or less, most preferably 40 cm or less.

As described above, preferably a self-heat bonding method is used as a method of bonding the fibers in the stretchable nonwoven fabric of the present invention, because this self-heat bonding method can improve the quality of the nonwoven fabric product due to an improved dispersion of the fibers, and has a lower cost.

Further, other heat bonding methods such as a heat embossing method, a heated roll method, a heated air method, an ultrasonic bonding method or the like can be used. In particular, the heat embossing method and the heated roll method using, for example, an upper metal roller and a lower rubber roll is more preferable, because a bonding between the fibers of the nonwoven fabric is thus increased and the strength, water proof bacteria barrier, dust proof properties and a surface smoothness, are improved by using this method. A treatment by the heat embossing method or the heated roll method may be conducted continuously without applying a winding process to the obtained web, or may be conducted as a separate process after the web is wound.

Preferably, the heat embossing treatment or the heated roll treatment are conducted at a temperature of 150° C. or lower, preferably 50° to 130° C., more preferably 60° to 120° C. and under a pressure of 0.5 to 100 kg/cm, preferably 1 to 75 kg/cm. When the treatment is conducted under a temperature and pressure higher than the above range, the fiber is melted and a nonwoven fabric having a film-like form and a lower air permeability is obtained. Conversely, when the treatment is conducted at a temperature and pressure lower than the above range, the heat bonding effect becomes poor, and thus it is impossible to improve the strength and the surface smoothness of the nonwoven fabric.

Either a continuous pattern or a discontinuous pattern can be used as an embossing pattern using in the heat-embossing treatment. Further, various patterns such as a line, a dotted line, a lattice, a diagonal lattice, a circle, a diamond, or a woven fabric-like pattern, or the like, can be used.

An electret treatment may be applied to improve a filtering property of the stretchable nonwoven fabric of the present invention.

Further, the stretchable nonwoven fabric of the present invention can be used by piling or laminating same with a sheet-like material such as another nonwoven fabric manufactured by a spun bond method, a carding method, a wet method or the like, a knitted fabric, a woven fabric, a film or the like. After these materials are piled, if necessary, the stretchable nonwoven fabric and the sheet-like material may be bonded by a heat bonding method, or an entanglement method or the like.

Various examples of the stretchable nonwoven fabric of the present invention, and comparative examples, will be described hereafter.

Before describing the examples, however, a definition of the physical properties of this specification, and the methods of measuring of same, are shown as follows.

Average fiber diameter (μM)

Ten randomly selected points of the samples are photographed by an electron microscope at a magnification of 200–2000, which value is determined by a diameter of the fiber. The diameters of random ten fibers are measured per one photograph, and this is repeated for the ten photographs. Then the measured diameter values for 100 fibers in total are found, to thus calculate a mean value.

Polymer ball; this is a ball-like polymer having a diameter of 50 to 1000 times the diameter of the fiber constituting the web, or a beaded polymer produced at the end or the intermediate part of the fiber. These polymer balls can be visible to the naked eye.

Strength and elongation; in accordance with JIS L-1096, a 2 cm wide sample is drawn at a grasp interval of 5 cm and a pulling rate of 10 cm/minute, to measure the strength and elongation per 1 cm width at the time of breaking.

(A measured value is expressed as a mean value of a value in a lengthwise direction and a value in a lateral direction.)

Extension recovery rate; a 2 cm wide sample of is stretched in accordance with JIS L-1096 at a grasp interval of 12 cm and a pulling rate of 10 cm/min, by an extension ratio of 50%, and immediately allowed to recover to the original length at the same rate. A difference (a) in length before and after an extension is found, based on a 10 cm line marked in the direction of extension prior to the extension. Accordingly, the recover is given as a 100% elastic recovery from an $$\text{elongation (\%)} = \frac{100 - a}{100} \times 100$$

(A measured value is expressed as a mean value of a value in a lengthwise direction and a value in a lateral direction.)

Stiffness; this is done is accordance with the JIS L-1096, 45° canti-lever method. (A measured value is expressed as a mean value of a value in a lengthwise direction and a value in a lateral direction.)

When this value is small, the handling of the fabric becomes soft method.

Extension stress; a stress at a 100% extensions taken as the extension stress, based on a chart used for the breaking strength and elongation. (A measured value is expressed as a mean value of a value in a lengthwise direction and a value in a lateral direction.)

Peel strength; a sample having a length of 10 cm and a width of 2 cm is prepared from the nonwoven fabric, and two samples are piled. A weight of 13 kg is laid on a central portion having a length of 2.7 cm and a width of 2 cm, of the piled samples, and left for 16 hours. The weight is removed from the sample, and the sample stretched in accordance with JIS L-1096. Namely, each end of one sample of the piled samples is grasped by a clamp of a tester, and each end is stretched at a pulling rate of 10 cm/min in such a manner that the two samples are separated, and a maximum strength required to completely peel the two samples apart is measured, and the peeling strength per 1 cm width is calculated from the maximum strength. (A measured value is expressed as a mean value of a value in a lengthwise direction and a value in a lateral direction.)

Collecting efficiency; first, a measurement by a PARTICLE COUNTER KC-01A supplied from Rion Co. Ltd. is conducted under the conditions of a flow rate of 500 cc per minute, and a diameter of a particle of 0.3 μM or more, for 30 sec without a sample, to obtain a value A (number), and then the sample is arranged on the counter to measure a number B of particles passed through the sample. The collecting efficiency is measured by the following equation.

$$\text{Collecting efficiency } (\%)=(1-B/A)\times 100$$

Water resistance pressure (m $H_2O$); carried out in accordance with JIS L-1092B Air permeability; carried out in accordance with JIS L-1096 (Fragility method)

The light resistance is measured in accordance with JIS L-1096, whereby a sample subjected to light radiation in a fado meter for 40 hours, and a fading of the sample and a strength retention ratio of a radiated sample are measured in comparison with a non-radiated sample.

Number-average molecular weight (Mn); the Mn is obtained from a styrene reduced molecular weight by Gel Permeation Chromatography (GPC)

Content of vinyl aromatic compound (wt %); a content of a vinyl aromatic polymer block in all of the polymers is measured in accordance with a method shown in J. Polymer Science Vol. 1, P. 429 1946 by L. M. Kolthoff et al., and a value S thereof is expressed as weight %.

Binding amount of 1,2 of a conjugated diene in the conjugated diene compound (wt %); a measurement is conducted of a sample of a polymer before hydrogenation is applied by an infrared spectrophotometry in accordance with the Hampton method, and is expressed as V.

Strength of Polymer; the measurement is conducted by using a dumbbell No. 3, in accordance with JIS K-6301.

Elongation of Polymer; the measurement is conducted by using a dumbbell No. 3, in accordance with JIS K-6301.

Melting viscosity; the measurement is conducted in a flow tester CFT 500 supplied by SHIMAZU SEISAKUSHO CO., equipped with a 0.5 MM diameter spinneret, 1.0 ml and one hole under the conditions of a weight of 10 kg, and a preheating for 6 minutes at a temperature of 300° C.

EXAMPLE 1

A successive block copolymerization is performed by using a lithium alkyl catalyst, to synthesize a butadiene-styrene-butadiene-styrene type block copolymer having a composition ratio wt % of 10-12.5-65-12.5, as a pre-polymer, whereby a pre-polymer having an Mn of 47,000, a polystyrene content S of 25 wt %, and a binding amount V of 1,2 of a conjugated diene of 31 wt % is obtained. Hydrogenation is applied to this pre-polymer, and a hindered amine series stabilizer of 0.5 wt % is added to produce a hydrogenated block copolymer as a raw material a pellet.

The thus-obtained hydrogenated block copolymer has a melt viscosity of a pellet thereof of 520 poise, and is fed to the extruder and heat-melted at an extruder temperature of 290° C. The molten copolymer then is fed into a nozzle having 200 orifices with a diameter of 0.4 MM diameter and aligned at a pitch of 1 mm, and extruded as a high speed fluid at an extruding rate of 0.2 g per minute. A super heated steam controlled to a temperature of 380° C. is used as the fluid, and this super-heated steam is injected from slits of a melt blown nozzle onto a molten copolymer, at a pressure of 0.6 kg/cm$^2$G, to thereby draw and thin the molten polymer. Then thinned fibers are sequentially collected on a running net conveyor, in which a distance between a die and a collector is 15 cm, to form a web. The obtained web is a nonwoven fabric having a superior stretchability and a soft handling. Tests of the physical properties of the obtained nonwoven were performed, and the results are shown in Table 1.

TABLE 1

| | Structure (Ratio of Composition) | B—A—B—A (10–12.5–65–12.5) |
|---|---|---|
| Physical properties of Nonwoven Fabric | Weight per unit area | 101 g/m$^2$ |
| | Mean diameter of fiber | 12.7 μm |
| | Strength | 424 g/cm |
| | Elongation | 571% |
| | Extension recovery | 99% |
| | Elongation stress | 62 g/cm |
| | Stiffness | 3.2 cm |
| | Peel Strength | 3 g/cm |
| | Light resistance (Fading) | 40–5 grade |
| | Water resistance pressure | 60 mm $H_2O$ |
| | Collecting efficiency | 28% |

COMPARATIVE EXAMPLES 1 AND 2

Tests are performed under the same conditions as in Example 1, except that Kraton G-1657X and G-1652 supplied from Shell Chemical are used as a raw material. Note, when using G-1652 the yarn is not tied, and thus a nonwoven fabric cannot be obtained. A constitution of a polymer, physical properties of the polymer, and physical properties of the nonwoven fabric of Comparative Example 1 are shown in Table 2, in comparison to Example 1.

Although a strength of the polymer of Kraton G-1657X is higher than that of Example 1, it was found that a strength of the nonwoven fabric is lower.

Further, it appears that a reason why a sample of Kraton G-1652 cannot be obtained is that a melt viscosity of Kraton G-1652 is relatively high, i.e., 1905 poises at 300° C.

TABLE 2

| | | Example 1 | Comparative example 1 Kraton G1657X | Comparative example 2 Kraton G1652 |
|---|---|---|---|---|
| Polymer constitution | Mn (1000) | 4.7 | 6.4 | 5.0 |
| | S (wt %) | 25 | 14 | 29 |
| | V (wt %) | 31 | 33 | 33 |
| Physical properties of polymer | Strength (kg/cm2) | 112 | 159 | 275 |
| | Elongation | 644 | 820 | 550 |
| | Melting viscosity (poise) | 520 | 930 | 1905 |
| Physical properties of non-woven fabric | Mean diameter of fiber (μm) | 12.7 | 15.0 | Sample cannot be obtained due to untying of yarn |
| | strength/ weight per unit area (g/cm/ g/m$^2$) | 4.2 | 1.0 | |
| | Elongation (%) | 571 | 437 | |
| | extension recovery rate % | 99 | 100 | |
| | Peeling strength (g/cm) | 3 | 48 | |

EXAMPLES 2 TO 4, COMPARATIVE EXAMPLES 3 AND 4

Stretchable nonwoven fabrics are manufactured under the same conditions as in Example 1, except that a prepolymer having a different number-average molecular weight Mn was used. The physical properties of the nonwoven fabric were investigated. The results are shown in Table 3.

The polymer in Comparative Example 3 is not solidified when forming a chip, and accordingly, a chip cannot be obtained, and thus the test was stopped. The melt viscosity in Comparative Example 4 is high, and a spinning property thereof is poor, and thus a web cannot be obtained.

TABLE 3

| | Comparative 3 | Example 2 | Example 3 | Example 4 | Comparative 4 |
|---|---|---|---|---|---|
| Mn (10000) | 2.5 | 3.7 | 4.6 | 5.4 | 6.8 |
| S (wt %) | 26 | 28 | 26 | 24 | 25 |
| V (wt %) | 33 | 32 | 36 | 38 | 34 |
| weight per unit area (g/m$^2$) | Chip cannot be obtained due to impossibility of setup | 102 | 106 | 113 | Spinning is impossible due to high melting viscosity |
| strength (g/cm) | | 263 | 482 | 361 | |
| strength/weight per unit area (g/cm/g/m$^2$) | | 2.6 | 4.5 | 3.2 | |
| Elongation action (%) | | 516 | 703 | 441 | |
| extension recovery rate (%) | | 98 | 100 | 94 | |
| Peeling strength (g/cm) | | 4 | 30 | 67 | |

EXAMPLES 5 TO 7, COMPARATIVE EXAMPLES 5 AND 6

Pre-polymers having different content(s) of styrene are synthesized to obtain block copolymers, stretchable nonwoven fabrics are manufactured under the same conditions as in Example 1, and the physical properties are investigated. The results are shown in Table 4. The polymer in Comparative Example 5 is not solidified when forming a chip, and accordingly, the chip cannot be obtained, and thus the test was stopped. The melt viscosity in Comparative Example 6 is high, a spinning property thereof is poor, and many polymer balls are generated, and thus a satisfactory web cannot be obtained.

TABLE 4

| | Comparative Example 5 | Example 5 | Example 6 | Example 7 | Comparative Example 6 |
|---|---|---|---|---|---|
| Mn (10000) | 4.8 | 5.1 | 4.6 | 4.7 | 4.6 |
| S (wt %) | 11 | 19 | 25 | 24 | 42 |
| V (wt %) | 32 | 36 | 37 | 38 | 33 |
| Weight per unit area (g/m$^2$) | Chip cannot be obtained due to impossibility of setup | 90 | 104 | 101 | Polymer balls are generated due to high melting viscosity |
| strength (g/cm) | | 281 | 364 | 272 | |
| strength/weight per unit area (g/cm/g/m$^2$) | | 3.1 | 3.5 | 2.7 | |
| Elongation (%) | | 867 | 649 | 456 | |
| extension recovery rate (%) | | 100 | 99 | 96 | |
| Peeling strength (g/cm) | | 82 | 74 | 1 | |

EXAMPLES 8 TO 10, COMPARATIVE EXAMPLES 7 AND 8

Pre-polymers having different 1,2-vinyl contents (V) of conjugated diene structures in a conjugated diene compound are synthesized to obtain block polymers, and stretchable nonwoven fabrics are manufactured under the same conditions as in Example 1. The physical properties are investigated, and the results shown in Table 5. In Comparative Example 8, a spinning property thereof is poor, a length of fiber obtained is short, and balls or powder-like materials exist in the web, and thus a satisfactory web cannot be obtained.

TABLE 5

| | Comparative Example 7 | Example 8 | Example 9 | Example 10 | Comparative Example 8 |
|---|---|---|---|---|---|
| Mn (10000) | 4.3 | 4.2 | 4.2 | 4.6 | 4.1 |
| S (wt %) | 25 | 28 | 25 | 25 | 29 |
| V (wt %) | 15 | 23 | 33 | 42 | 53 |
| Weight per unit area (g/m$^2$) | 95 | 98 | 101 | 103 | Short length of fiber ball or powder like materials |
| strength (g/cm) | 141 | 253 | 364 | 341 | |
| strength/weight per unit area (g/cm/g/m$^2$) | 1.5 | 2.6 | 3.6 | 3.3 | |
| Elongation (%) | 162 | 394 | 560 | 738 | |
| extension recovery rate (%) | 44 | 87 | 99 | 100 | |
| Peeling strength (g/cm) | 0 | 0.5 | 16 | 238 | |

EXAMPLES 11 TO 13, COMPARATIVE EXAMPLE 9

A raw material is prepared by hydrogenating a pre-polymer having Mn of 51000, S of 25.5 wt % and V of 36 wt %, and stretchable nonwoven fabrics are manufactured under the same conditions as in Example 1, except that the extruder temperature is 300° C., the gas temperature is 400° C., the gas pressure is 0.5 kg/cm$^2$G and the distance between a die and a collector is 10 cm. The stretchable nonwoven fabric in Example 11 is treated by a pair of heated roller an upper roller of which is a metal roller and a lower roller of which is a rubber roller, under conditions of a temperature and a pressure as shown in Table 6. The results are shown in Table 6. The nonwoven fabric in Comparative Example 9 became a film-like form, and accordingly, a measurement of the physical properties was not performed.

TABLE 6

| | | Example 11 | Example 12 | Example 13 | Comparative Example 8 |
|---|---|---|---|---|---|
| Condition of Treatment | temperature (C.°) | untreated | 110 | 100 | 140 |
| | Pressure | | 6 | 40 | 40 |
| Weight per unit area (g/m$^2$) | | 116 | 134 | 124 | Film-like material |
| strength (g/cm) | | 522 | 718 | 740 | |
| strength/weight per unit area (g/cm/g/m$^2$) | | 4.5 | 5.4 | 6.0 | |
| Elongation (%) | | 726 | 782 | 784 | |

TABLE 6-continued

| | Example 11 | Example 12 | Example 13 | Comparative Example 8 |
|---|---|---|---|---|
| Extension recovery rate (%) | 100 | 99 | 100 | |
| Stiffness (cm) | 2.9 | 2.7 | 1.9 | |

EXAMPLE 14 COMPARATIVE EXAMPLES 10 AND 11

A hydrogenated block copolymer is manufactured by hydrogenating a pre-polymer having an Mn of 49,000, S of 29 wt %, and V of 36 wt %, and sequentially, a chip is made from the hydrogenated block copolymer. Further, a polyethylene having an Mn of 2880 and the density of 0.930 is added to the chip of the hydrogenated block copolymer by 30 wt %, and then a raw material is prepared by melting and blending the two materials in a double-screw extruder. A stretchable nonwoven fabric of Example 14 is manufactured from the raw material under the same conditions as in Example 1, except that a gas pressure is 0.3 kg/cm$^2$G and a distance between the die and the collector is 10 cm, and physical properties thereof investigated. Stretchable nonwoven fabrics in Comparative Examples 10 and 11 are manufactured under the same conditions as in Example 14, except that Kraton G1657X and G-1652 supplied from Shell Chemical Co. are used in place of the hydrogenated block copolymer of the present invention, and the physical properties thereof investigated. The results are shown in Table 7. The nonwoven fabrics prepared from Kraton G-1657X and G-1652 have a lower strength and elongation than the nonwoven fabric of Example 14.

TABLE 7

| | Example 14 | Comparative example 10 Kraton G-1657X | Comparative example 11 Kraton G-1652 |
|---|---|---|---|
| Additional amount of Polyethylene (wt %) | 30 | 30 | 30 |
| weight per unit area (g/m$^2$) | 98 | 90 | 94 |
| strength (g/cm) | 291 | 68 | 141 |
| strength/weight per unit area (g/cm/g/m$^2$) | 3.0 | 0.8 | 1.5 |
| Elongation (%) | 526 | 388 | 360 |
| Extension recovery rate (%) | 97 | 97 | 97 |
| Elongation stress (g/cm) | 102 | 60 | 69 |
| Peeling strength (g/cm) | 0 | 43 | 0 |
| Collecting efficiency (%) | 19.8 | 11.4 | 6.6 |

EXAMPLES 15, 16 AND 17, COMPARATIVE EXAMPLE 12

Stretchable nonwoven fabrics are manufactured under the same conditions as in Example 14, except that added amount of the polyethylene is 5 wt %, 15 wt %, 45 wt % and 70 wt %, the gas pressure is 0.6 kg/cm$^2$G and the distance between the die and the collector is 7 cm, and physical properties thereof investigated. The results are shown in Table 8.

TABLE 8

| | Example 15 | Example 16 | Example 17 | Comparative Example 12 |
|---|---|---|---|---|
| Additional amount of polyethylene (wt %) | 5 | 15 | 45 | 70 |
| Weight per unit area ($g/m^2$) | 96 | 96 | 101 | 99 |
| Strength (g/cm) | 265 | 388 | 455 | 460 |
| Strength/weight per unit area ($g/cm/g/m^2$) | 2.8 | 4.0 | 4.5 | 4.6 |
| Elongation (%) | 434 | 563 | 310 | 142 |
| Extension recovery rate (%) | 98 | 99 | 92 | 67 |
| Elongation stress (g/cm) | 79 | 91 | 240 | 310 |
| Peeling strength (g/cm) | 0 | 0 | 0 | 0 |

EXAMPLES 18 TO 21

Stretchable nonwoven fabrics are manufactured under the same conditions as in Example 16, the added amount of the polyethylene being 15 wt %, except that the Mn of the polyethylene is made 2800 (density of 0.930), 3400 (density of 0.928), 12000 (density of 0.918) and 17000 (density of 0.929) and the gas pressure is 0.7 $kg/cm^2G$, and physical properties thereof investigated. The results are shown in Table 9.

TABLE 9

| | Example 18 | Example 19 | Example 20 | Comparative 21 |
|---|---|---|---|---|
| Polyethylene (Mn) | 2880 | 3400 | 12000 | 17000 |
| Weight per unit area ($g/m^2$) | 100 | 99 | 94 | 102 |
| Strength (g/cm) | 292 | 369 | 226 | 256 |
| Strength/weight per unit area ($g/cm/g/m^2$) | 2.9 | 3.7 | 2.4 | 2.5 |
| Elongation (%) | 566 | 558 | 320 | 270 |
| Extension recovery rate (%) | 99 | 99 | 97 | 96 |
| Elongation stress (g/cm) | 65 | 69 | 82 | 120 |
| Peeling strength (g/cm) | 0 | 0 | 0 | 0 |

EXAMPLES 22 AND 23

Stretchable nonwoven fabrics are manufactured under the same conditions as in Example 14, except that two types of polypropylenes having an Mn of 40,000 (MFR of 240) and an Mn of 50,000 (MFR of 80) are added by 12 wt %, in place of the polyethylene, and physical properties thereof investigated. The results are shown in Table 10.

TABLE 10

| | Example 22 | Example 23 |
|---|---|---|
| polypropylene (Mn) | 40,000 | 50,000 |
| mean diameter of fiber (μm) | 18.5 | 19.6 |

TABLE 10-continued

| | Example 22 | Example 23 |
|---|---|---|
| Weight per unit area ($g/m^2$) | 99 | 102 |
| Strength (g/cm) | 335 | 300 |
| Strength/weight per unit area ($g/cm/g/m^2$) | 3.4 | 2.9 |
| Elongation (%) | 436 | 451 |
| Extension recovery rate (%) | 95 | 93 |
| Elongation stress (g/cm) | 109 | 115 |
| Peeling strength (g/cm) | 0 | 0 |

EXAMPLE 24

A stretchable nonwoven fabric is manufactured under the same conditions as in Example 14, except that a polypropylene having an Mn of 50,000 (MFR of 80) is added by 20 wt %, and a raw material is prepared by a chip blending operation, the gas pressure is 3.0 $kg/cm^2G$ and the distance between the die and the collector is 30 cm, and the physical properties thereof investigated. The results are shown in Table 11. A mean diameter of fibers constituting this nonwoven fabric is extremely thin, and thus the nonwoven fabric has an extremely soft handling.

TABLE 11

| | | Example 24 |
|---|---|---|
| Weight per unit area ($g/m^2$) | | 123 |
| Mean diameter of fiber (μm) | | 3 |
| Strength (g/cm) | | 742 |
| Elongation (%) | | 280 |
| Extension recovery rate (%) | | 93 |
| Elongation stress (g/cm) | | 109 |
| Water resistant pressure ($mmH_2O$) | | 540 |
| Air Permeability (cc/cm/sec) | | 10 |
| Collecting efficiency (%) | | 55 |
| Light resistance | Retaining ratio of Strength (%) | 92 |
| | Fading (grade) | 4–5 |

Further, the obtained nonwoven fabric is applied with the voltage of 19 KV to perform an electric treatment, and the collecting efficiency thus improved to 86%.

EXAMPLES 25 TO 27, COMPARATIVE EXAMPLES 13 AND 14

Stretchable nonwoven fabrics are manufactured under the same conditions as in Example 24, except that an amount of the polypropylene chip to be blended are changed, and the physical properties thereof investigated. The results are shown in Table 12.

When the spinning operation is performed without the addition of polypropylene, a material similar to a powder, compared with a fiber, is obtained and many polymer balls are found, and thus a nonwoven fabric having a good quality cannot be obtained (refer to Comparative Example 13).

TABLE 12

| | Comparative example 13 | Example 25 | Example 26 | Example 27 | Comparative example 14 |
|---|---|---|---|---|---|
| Blending ratio of PP (wt %) | 0 | 15 | 30 | 50 | 70 |
| Weight per unit area (g/$^2$) | Sample cannot be obtained due to power-like form | 102 | 108 | 105 | 102 |
| Mean diameter of fiber (μm) | | 3.9 | 2.5 | 2.0 | 1.7 |
| Strength (g/cm) | | 508 | 626 | 546 | 490 |
| Strength/weight per unit area (g/cm/g/m2) | | 5.0 | 5.8 | 5.2 | 4.8 |
| Elongation (%) | | 394 | 180 | 82 | 44 |
| Extension recovery rate (%) | | 98 | 92 | 78 | No measurement |

EXAMPLES 28 TO 30

Stretchable nonwoven fabrics are manufactured under the same conditions as in Example 1, except that a hydrogenated block copolymer is manufactured by hydrogenating a prepolymer having an Mn of 53,000, an S of 20 wt % and a V of 36 wt %, and sequentially, a chip is made from the hydrogenated block copolymer, three types of polypropylenes having an Mn of 45,000 (MFR of 140), an Mn of 50,000 (MFR of 80) or an Mn of 53,000 (MFR of 40) are added to the chip, to blend the polypropylene with the hydrogenated block copolymer in the chip state, and the obtained chip is fed to an extruder under the conditions of a gas pressure of 2.5 kg/cm$^2$G and a distance between the die and the collector of 50 cm. The physical properties thereof were investigated, and the results are shown in Table 13.

TABLE 13

| | Example 28 | Example 29 | Example 30 |
|---|---|---|---|
| Polypropylene (10,000) | 4.5 | 5.0 | 5.3 |
| Weight per unit area (g/m$^2$) | 38 | 42 | 38 |
| strength (g/cm) | 102 | 259 | 188 |
| Strength/weight per unit area (g/cm/g/m2) | 2.7 | 6.2 | 5.0 |
| Elongation (%) | 158 | 160 | 124 |
| Extension recovery rate (%) | 84 | 92 | 90 |

EXAMPLES 31, 32 AND 33

A raw web is manufactured under the same conditions as in Example 24, except that a distance between the die and the collector is 50 cm, and sequentially, a heat bonding treatment is applied by a heat embossing roll, and the physical properties of the obtained nonwoven fabric investigated. The results are shown in Table 14.

Figure 4:
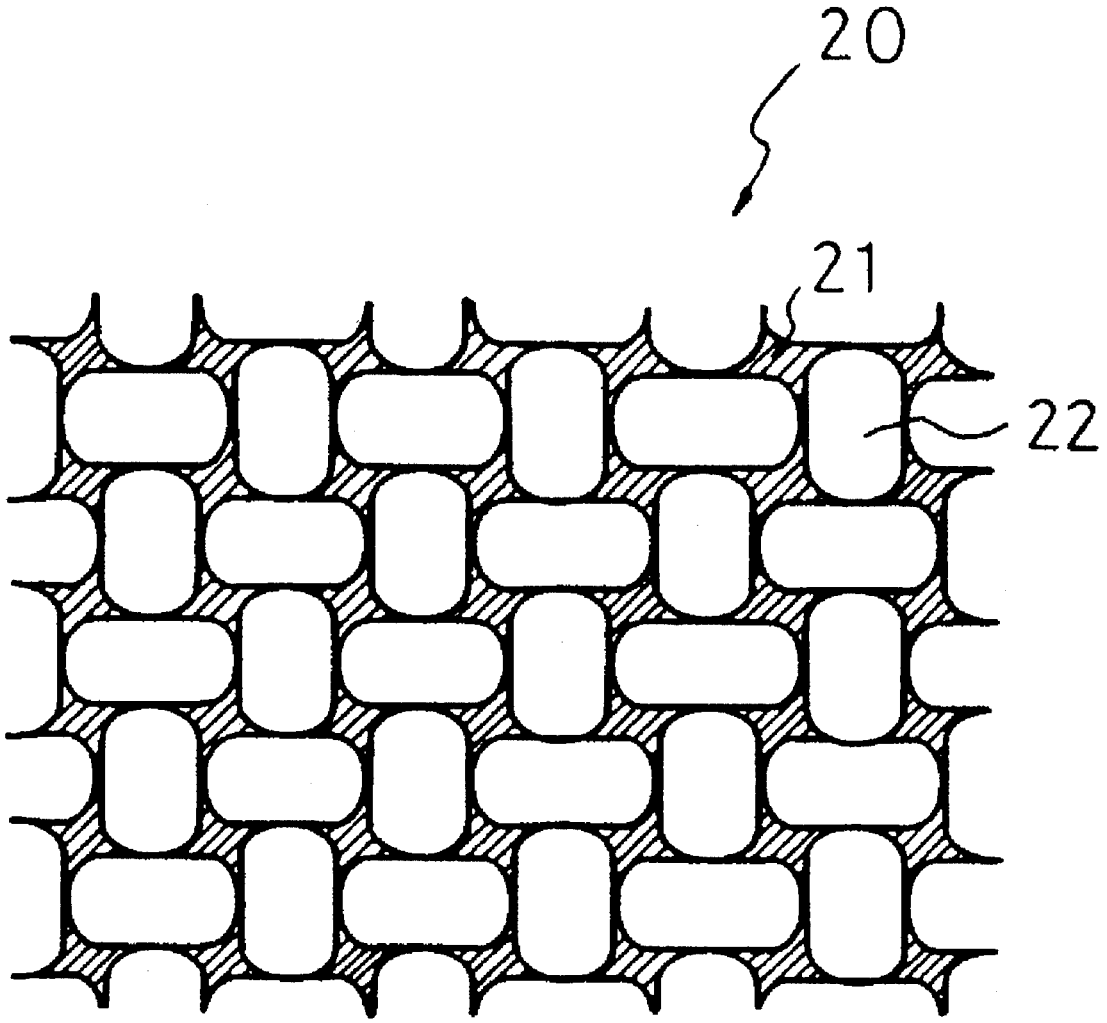
FIG. 4 is a plain view illustrating an example of an emboss pattern.

An embossing pattern applied with the heat embossing roll is a pattern 20 having a compressed portion 21, an unpressed portion 22, and an area ratio of the compressed portion of 22%, as shown in FIG. 4.

TABLE 14

| | | Example 31 | Example 32 | Example 33 |
|---|---|---|---|---|
| Condition of Treatment | temperature (C.°) | untreated | 70 | 90 |
| | pressure (kg/cm) | | 6 | 15 |
| weight per unit area (g/m$^2$) | | 116 | 119 | 125 |
| strength (g/cm) | | 381 | 551 | 760 |
| Strength/weight per unit area (g/cm/g/m$^2$) | | 3.3 | 4.6 | 6.1 |
| Elongation (%) | | 192 | 253 | 304 |
| Extension recovery rate (%) | | 98 | 94 | 93 |
| Elongation stress (g/cm) | | 213 | 245 | 285 |
| water resistant pressure (mmAq) | | 420 | 640 | 800 |
| collecting efficiency (%) | | 52 | 58 | 63 |

The nonwoven fabric in Example 24 is stretched to a length twice that of an original length, and then inserted between two spun-bonded nonwoven fabrics of polypropylene, and further, a heat bonding treatment is applied to the piled nonwoven fabrics by an embossing roll having a discontinuously arranged circular pattern. The obtained composite nonwoven fabric is a nonwoven fabric with gathers, and an elongation thereof is 100%.

EXAMPLE 34

The hydrogenated block copolymer obtained in Example 1 is fed into an extruder, and the copolymer is melted under a superheated heated condition at 300° C., and is extruded from 100 orifices at an individual extruding amount of 0.7 g/min. The fibers are drawn by an air sucker arranged below the extruder, and are piled on a net conveyor arranged below the sucker, to form a web. A dispersion property of the web just after spinning is not good. This web is applied with a heat bonding treatment by a heat roll, an upper roll of which is a metal roll and a lower roll of which is a rubber roll, having a temperature of 110° C. and at a pressure of 15 kg/cm, to obtain nonwoven fabric. The obtained nonwoven fabric having a weight per unit area of 130 g/m$^2$ has a strong strength, i.e., 1.1 g/cm, and a superior stretchability.

EXAMPLES 35 AND 36

Stretchable nonwoven fabrics are manufactured under the same conditions as that in Example 1, except that two pre-polymers of a butadiene-styrene-butadiene-styrenebutadiene type block copolymer having a composition ratio (wt %) of 10-15-50-15-10 and having a different Mn are used, and various tests of the physical properties thereof are applied. The results are shown in Table 15.

TABLE 15

| | Example 35 | Example 36 |
|---|---|---|
| Mn (10000) | 4.4 | 5.3 |
| Weight per unit area (g/m$^2$) | 105 | 103 |
| Strength (g/cm) | 356 | 297 |
| Strength/weight per unit area (g/cm/g/m$^2$) | 3.4 | 2.9 |
| Elongation (%) | 682 | 160 |
| Extension recovery rate (%) | 95 | 93 |

CAPABILITY OF EXPLOITATION IN INDUSTRY

Since the stretchable nonwoven fabric in accordance with the present invention is constituted as described above, the stretchable nonwoven fabric of the present invention has a superior strength, extension characteristics i.e., elongation and extension recovery, weathering resistance, light resistance, heat resistance, chemical resistance and electrical resistance, and a soft handling.

Accordingly, the stretchable nonwoven fabric in accordance with the present invention can be broadly used as a medical and sanitary material, for articles as such a compress, a stretchable tape, a bandage, a diaper or the like, an apparel such as surgical wear, working wear, caps or hats or the like, or as industrial goods such as gloves, a covering material for an electric wire, or the like.

The stretchable nonwoven fabric in accordance with the present invention and having the above described characteristics can be stably manufactured by the manufacturing method in accordance with the present invention.

We claim:

1. A stretchable meltblown nonwoven fabric having a weight per unit area of 5 to 500 g/m$^2$, a mean diameter of fibers of 0.5 to 30 μm, and a strength per weight per unit area of 2.4 g/cm/g/m$^2$ or more, composed of a thermoplastic fiber comprising a hydrogenated block copolymer C obtained by hydrogenating a block copolymer including two to about four polymer blocks A composed mainly of a vinyl aromatic compound and two to about four polymer blocks B constituted mainly of a conjugated diene compound, at least one polymer block B being arranged on an end of a polymer chain thereof, the number-average molecular weight of said block copolymer being between 30,000 and 65,000 and the content S of the vinyl aromatic compound in the block copolymer being between 15 wt % and 40 wt % and the remaining content being the conjugated diene compound, the content V of a 1,2-vinyl structure of the conjugated diene compound being between 20 wt % and 50 wt % and the remaining content of the conjugated diene compound being structures other than the 1,2-vinyl structure, and a polyolefin D, wherein a blending ratio (C/D) of the hydrogenated block copolymer and the polyolefin D is between 40/60 and 99/1.

2. A stretchable nonwoven fabric according to claim 1, wherein said blending ratio (C/D) is between 50/50 and 95/5.

3. A stretchable nonwoven fabric according to claim 1, wherein said polyolefin is a polyethylene.

4. A stretchable nonwoven fabric according to claim 1, wherein said polyolefin is a polypropylene.

5. A stretchable nonwoven fabric according to claim 1, wherein the mean diameter of fibers constituting said nonwoven fabric is 10 μm or less.

6. A stretchable nonwoven fabric according to claim 1, wherein the mean diameter of fibers is 1 to 6 μm.

* * * * *